US006298493B1

(12) United States Patent
Ambroise

(10) Patent No.: US 6,298,493 B1
(45) Date of Patent: Oct. 9, 2001

(54) EAR PROTECTOR

(76) Inventor: Bernice Ambroise, 2425 Mission Rd., Suite 1901, Tall, FL (US) 32304

( * ) Notice: Subject to any disclaimer, the term of this patent is extended or adjusted under 35 U.S.C. 154(b) by 0 days.

(21) Appl. No.: 09/054,887

(22) Filed: Apr. 3, 1998

Related U.S. Application Data

(60) Provisional application No. 60/043,949, filed on Apr. 16, 1997.

(51) Int. Cl.[7] ..... A61F 11/14
(52) U.S. Cl. ..... 2/209; 2/174; 128/866
(58) Field of Search ..... 2/174, 209, 423; 128/864, 866

(56) References Cited

U.S. PATENT DOCUMENTS

| | | | | |
|---|---|---|---|---|
| 243,168 | * | 6/1881 | Spitz | 2/209 |
| 2,428,897 | | 10/1947 | Ungemah . | |
| 3,452,365 | | 7/1969 | Wallace . | |
| 4,134,153 | | 1/1979 | Voorhees . | |
| 4,872,219 | | 10/1989 | Duncan . | |
| 4,916,758 | | 4/1990 | Jordan-Ross . | |
| 4,935,965 | | 6/1990 | Wassell . | |
| 5,257,420 | | 11/1993 | Byrne, Jr. . | |
| 5,718,001 | * | 2/1998 | Wright | 2/209 |

FOREIGN PATENT DOCUMENTS

| | | |
|---|---|---|
| 2010640 | 6/1979 | (GB) . |
| WO 81/02515 | 9/1981 | (WO) . |

* cited by examiner

*Primary Examiner*—Diana L. Oleksa

(57) ABSTRACT

An ear protector dimensioned and configured to secure over the user's ear, protecting the ear from the harmful effects of hot curling irons and blow dryers. The ear protector has a three layer construction having a cotton fiber or cotton fabric exterior, a Teflon® or a similar type material located in the center and a cotton or soft batting in the interior. The three layer construction acts as a heat shield which protects the user from receiving painful burns. The cotton batting inner covering is attached to the outer covering via stitching. An elastic band is secured to both the inner covering and outer covering adjacent to the stitching and secures the ear protector safely over the user's ear. Alternatively, a draw string can be used in place of the elastic band to secure the ear protector over the user's ear. In addition, aesthetically pleasing indicia is placed upon the outer covering of the ear protector such that a certain style or charm is added to the practicality.

9 Claims, 7 Drawing Sheets

FIG 6

EAR PROTECTOR

CROSS REFERENCE TO RELATED APPLICATION

This application is based on Provisional Patent Application Ser. No. 60/043,949 filed Apr. 16, 1997.

BACKGROUND OF THE INVENTION

1. Field of the Invention

The invention relates generally to ear protectors. More specifically, the invention relates to a protective covering for the ears which will prevent burns resulting from contact with hot curling irons or overheating due to hot blow dryers.

2. Description of Related Art

Curling irons, hot curlers, and straightening combs, by design, are very hot to the touch. Although beneficial when used to curl hair, the irons, curlers and combs can be detrimental if brought into contact with the user's ear. Likewise, blow dryers can cause harm to sensitive ears due to the high intensity heat from the blow dryer. Many women have experienced the pain that results from accidentally touching their ear with the iron. One slight touch is all that is required to receive a painful burn. In addition to the associated pain, the burn often leaves a noticeable burn mark or scab on the user.

Women everywhere as well as hair stylists would find great relief in a device that would prevent burns and heat irritation due to hot curling irons and blow dryers. No longer would they have to suffer the pain associated with burns or the embarrassing and unsightly scabs resulting therefrom. They would enjoy the freedom and reassurance to style their hair without regard or fear of burning their ears. In addition, if such a device included aesthetically pleasing indicia thereupon, it would add a certain style or charm giving the device beauty along with practicality. Furthermore, if the device was machine washable then the product could be easily washed and used for other customers (a great advantage for the professional hair stylist) or washed and used over again by the individual consumer (eliminating the necessity of having to buy extra products). There is, therefore, a need for an ear protector that would protect the wearer's ears from burns due to hot curling irons and blow dryers, has a soft lining to add comfort, allows easy and adjustable attachment to the wearer's ear, has aesthetically pleasing indicia on the outer surface, and is machine washable. The present invention provides such a device.

Ear protectors have been described in the patent literature. For example, U.S. Pat. No. 4,134,153 issued to Voorhees on Jan. 16, 1979, U.S. Pat. No. 4,872,219 issued to Duncan on Oct. 10, 1989, U.S. Pat. No. 5,257,420 issued to Byrne, Jr. on Nov. 2, 1993, U.S. Pat. No. 2,428,897 issued to Ungemah on Oct. 14, 1947, United Kingdom Pat. No. 2,010,640 published Jun. 27, 1979, and WO No. 81/02515 published on Sep. 17, 1981 all describe ear covers, but fail to disclose an ear protector using protective fibers to shield the ear from burns, an elastic band to secure the ear protector around the ear, and a draw string to allow adjustment of the ear protector around variously sized ears.

U.S. Pat. No. 4,935,965 issued to Wassell on Jun. 26, 1990, U.S. Pat. No. 3,452,365 issued to Wallace on Jul. 1, 1969, and U.S. Pat. No. 4,916,758 issued to Jordan-Ross on Apr. 17, 1990 all describe ear covers, but fail to disclose ear protectors which incorporate Teflon® disposed between an exterior made of cotton fabric and an interior made of cotton batting. Furthermore, the patents fail to disclose ear protectors having an elastic band or draw strings to secure the ear protectors around the user's ears.

None of the above inventions and patents, taken either singly or in combination, is seen to describe the instant invention as claimed.

SUMMARY OF THE INVENTION

The invention relates to an ear protector made out of cotton batting (other materials, namely polyester and/or acrylic can be used) and a Teflon® or similar type material located between a cotton fabric exterior (other materials, namely Thermoflex or any appropriate heat resistant material can be used) and a cotton batting interior. Whereas the Teflon® or similar type material protects the ear from the harmful effects of a hot curling iron or blow dryer, the cotton batting adds a lining which comfortably rests against the ear of the user. The ear protector forms a pocket which attaches to and completely covers the user's ear. The pocket is sized to the lobe of the ear and has an opening smaller than the lobe for its passage into the pocket. Around the periphery of the opening, an elastic band is affixed which resiliently bands the ear when the lobe is inserted into the pocket. Likewise, draw strings can be used in lieu of an elastic band which can be manually drawn to adjust the tension of the band around the ear of the user as desired. Suede or leather cording can be used for the drawstring.

Accordingly, it is a principal object of the invention to provide an ear protector which protects the wearer's ear from burns due to hot curling irons or blow dryers.

It is another object of the invention to provide an ear protector having an inner liner made of soft batting.

It is a further object of the invention to provide an ear protector having an outer covering made of cotton fabric whereas Teflon® or similar heat resistant material is disposed between the inner liner and outer covering.

Still another object of the invention is to provide an ear protector which uses draw strings to adjustably secure the protector over the wearer's ear.

It is again an object of the invention to provide an ear protector which uses an elastic band to secure the protector over the wearer's ear.

Yet another object of the invention is to provide an ear protector wherein each ear protector is attached together via a draw string.

Again, it is an object of the invention to provide an ear protector wherein the draw string which attaches two protectors is adjustable via an adjustor.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to an ear protector dimensioned and configured to secure over the user's ear, protecting the ear from harmful effects of hot curling irons and blow dryers. The outer covering of the ear protector is made a cotton fiber or fabric material. An inner covering is attached to the outer covering via stitching and is made of cotton batting which adds comfort to the user and acts as an insulator against noise and heat of a blow dryer. Disposed between the inner and outer covering is a Teflon® or a similar type material that acts as a heat shield which protects the user from receiving painful burns. An elastic band is secured to both the inner covering and outer covering and secures the ear protector safely over the user's ear. Alternatively, a draw string can be used in place of the elastic band to secure the ear protector over the user's ear.

Figure 1:
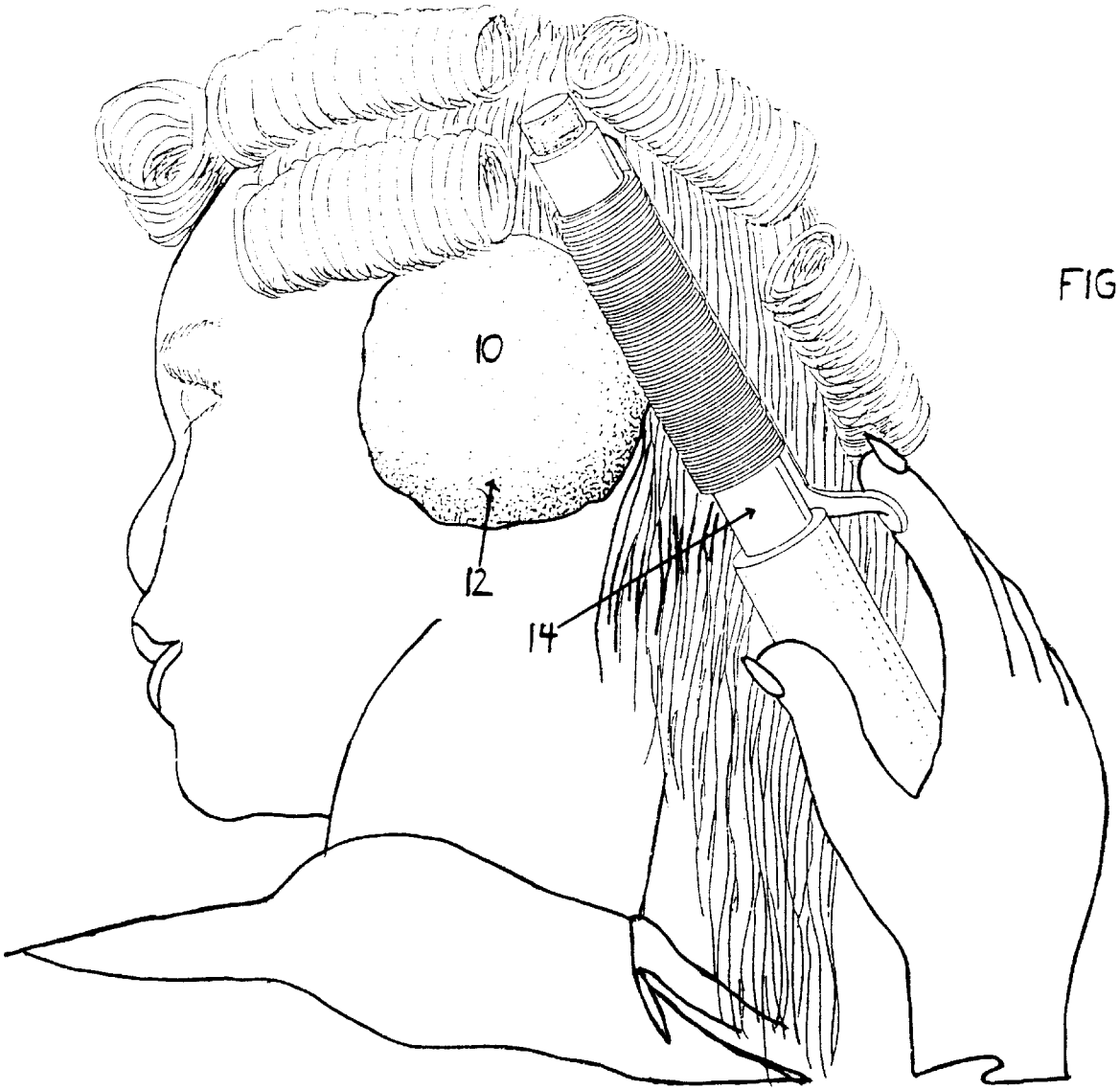
FIG. 1 is an environmental view of the ear protector shown worn over the wearer's ear.

Turning now to FIG. 1 of the drawings, ear protector 10 is illustrated secured over the ear of the user. The outer covering 12 is made of a cotton fiber or fabric and protects the ear from burns due to hot curling irons 14 or blow dryers (not shown). As illustrated in FIG. 1, when in use, the hot curling iron 14 comes into close proximity to the user's ear and could damage the ear if it accidentally touches the ear. The heat resistant outer covering 12 prevents damage to the ear and allows the user to style her hair without fear of damaging her ear. Moreover, due to the extended contact the outer covering 12 makes with the curling iron, the material must have properties which prevent the material from melting or combusting.

Figure 2:
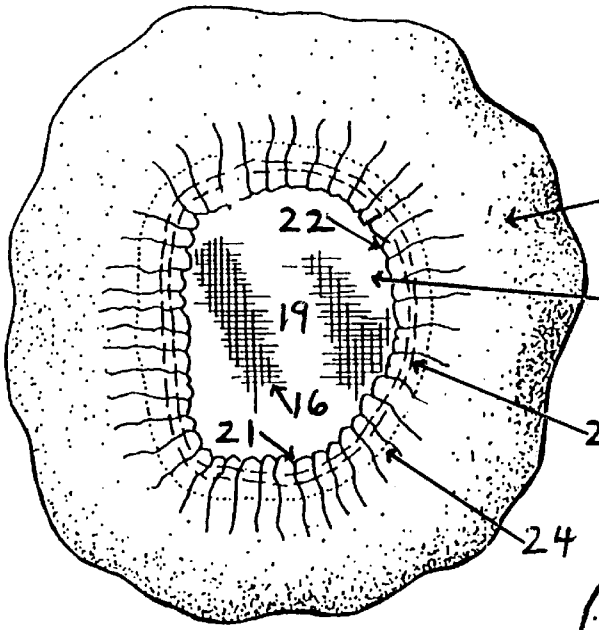
FIG. 2 is a front elevational view of the preferred embodiment.

A front view of the ear protector 10 is illustrated in FIG. 2 of the drawings. Inner chamber 18 is defined by inner covering 16 and is of sufficient size to completely cover the ear of the user. Inner covering 16 is made of cotton, polyester, acrylic or any soft material which will add to the sense of comfort to the user. An opening 19, defined by end 21, leads to chamber 18. The size of opening 19 increases or decreases due to the expansion or contraction of elastic band 20. Stitch 24 is located adjacent elastic band 20 and attaches to the inner covering 16 to the outer covering 12. Folds 22, located in outer covering 12, not only allow added outer covering material to expand with expansion of the elastic band, but also form a cushion or barrier which protects the ear from irritation due to the contracted elastic band 20. The elasticity of elastic band 20 nevertheless provides a tight and secure attachment of the elastic band 20 over the user's ear. To place the ear protector 10 around the ear the user stretches elastic band 20 such that it will fit over the ear of the user. Next the user places ear protector 10 over the ear and releases elastic band 20, the natural elasticity of elastic band 20 will cause ear protector 10 to secure itself around the ear.

Figure 3:
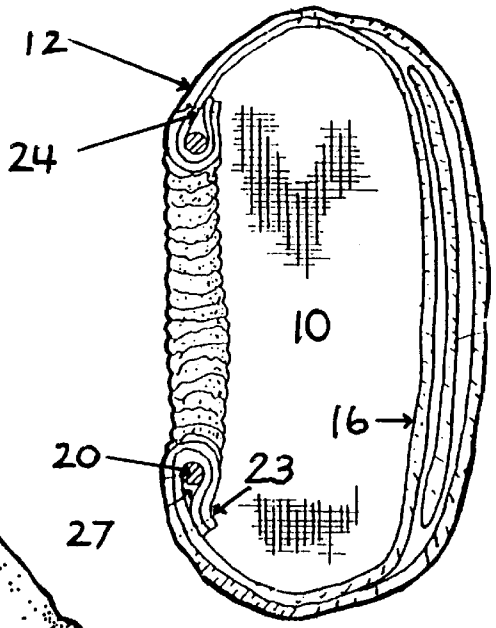
FIG. 3 is a right side sectional view drawn along line 3—3 of FIG. 2.

FIG. 3 of the drawings shows a cross sectional view of the ear protector 10, taken along lines 3—3 of FIG. 2, illustrating how elastic band 20 may be connected, inner and outer coverings 16, 12 forming a passage or loop for elastic band 20. Elastic band 20 is continuous in shape and is disposed completely within inner covering 16. Inner covering 16 and outer covering 12 form contiguous layers, and are folded backwards towards themselves (seen generally at 23) such that elastic band 20 is contained within the loop 27. Stitching 24 secures both the inner covering 16 and outer covering 12 together while simultaneously enclosing elastic band 20 therein as seen at 23. A heat resistant material 15 (preferably Teflon® or similar material) is disposed between the inner covering 16 and outer covering 12 and acts as an added protection against burns from the hot curling iron. Teflon® is a preferred material, as it may be provided in a flexible, woven fabric suitable for use as a protective element in the present invention.

Figure 4:
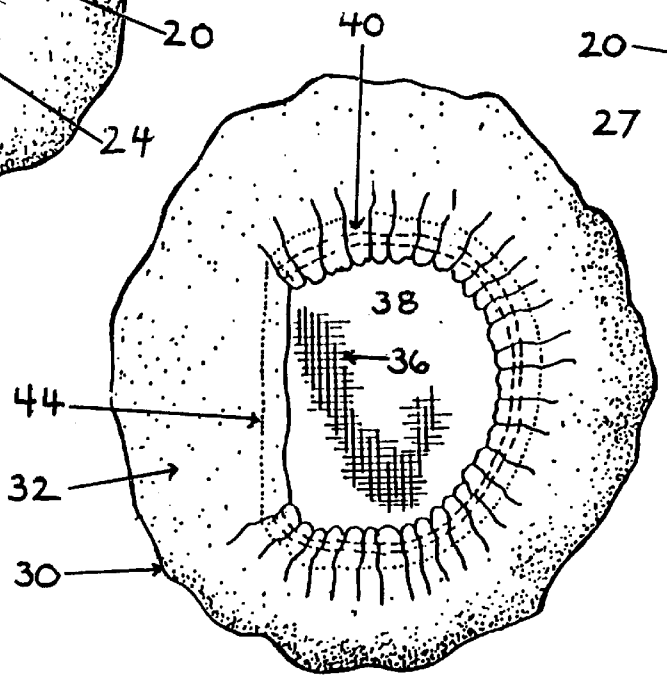
FIG. 4 is a front elevational view of a second embodiment.
Figure 5:
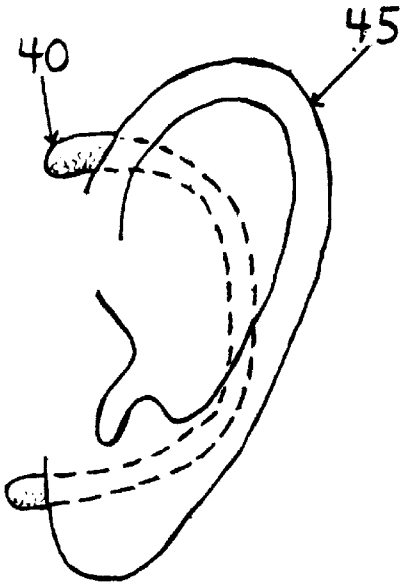
FIG. 5 is an environmental view of an attachment cord of the second embodiment with the ear protector covering removed for clarity of illustration.

A second embodiment is illustrated in FIG. 4 of the drawings. An ear protector 30 is shown with an outer covering 32 attached to an inner covering 36 via stitching 44. An inner chamber 38 is defined by the inner covering 36. An elastic cord 40 is disposed within and secured to inner covering 36 in a similar fashion as elastic band 20 of FIG. 3. Elastic cord 40 is not continuous and does not form a loop and is disposed completely within inner covering 36, thus necessarily being attached to the inner lining 16. The design of elastic cord 40 is shown in FIG. 5 of the drawings. Elastic cord 40 is designed to fit snugly around the back of the ear 45. To place elastic cord 40 over the ear 45, the user stretches cord 40 such that it will fit over the ear 45. Once over the ear 45, the user releases cord 40. The natural elasticity of elastic cord 40 will cause it to contract tightly around the ear 45.

Figure 6:
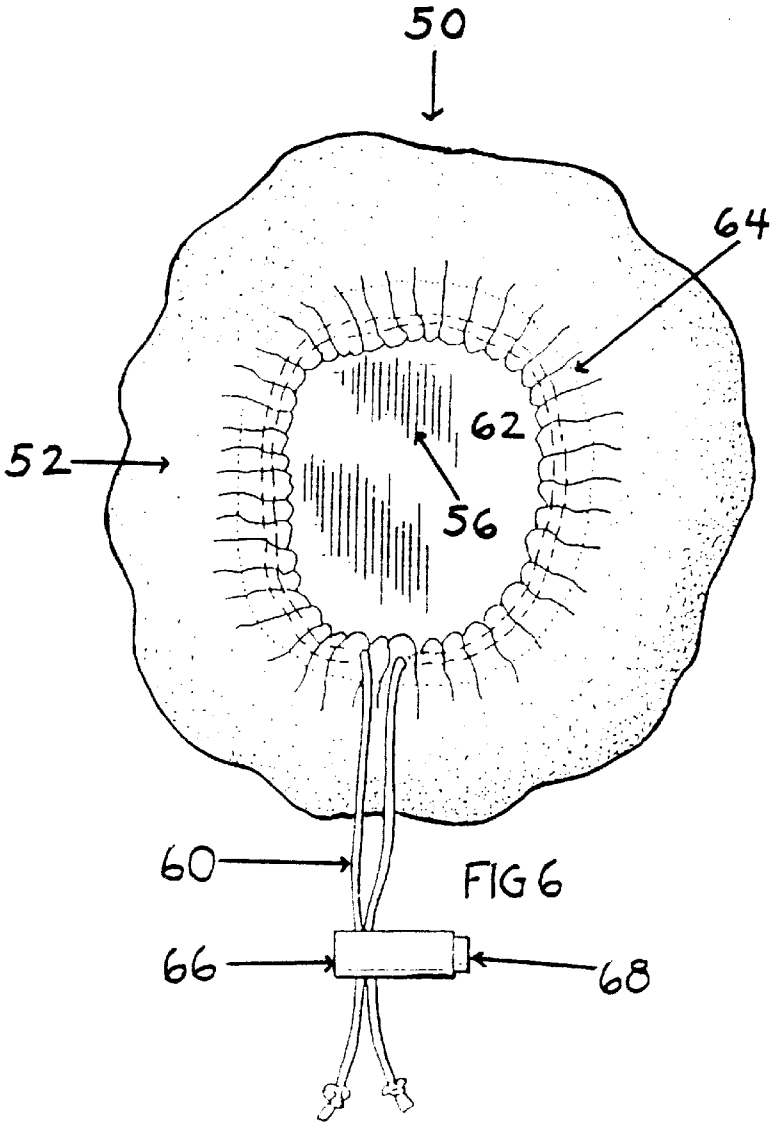
FIG. 6 is a front elevational view of a third embodiment employing a draw string.

A third embodiment is illustrated in FIG. 6 of the drawings. The ear protector 50 is substantially the same as the ear protector disclosed in the first embodiment except that a drawstring 60 replaces the elastic band. Drawstring 60 is disposed within inner covering 56 whereas inner covering 56 and outer covering 52 are attached together via stitching 64. Drawstring 60 runs through drawstring adjuster 66 or drawbead. Button 68 is located on the end of drawstring adjuster 66 and secures drawstring 60 in a desired position. To adjust the tightness of the drawstring 60 around the user's ear, opening 62 is placed over the user's ear such that the user's ear is placed within chamber 58. By depressing button 68, the drawstring adjuster 66 is slid upwards and towards inner covering 56 until the drawstring 60 is tight around the user's ear. At this point button 68 is then released to secure the drawstring 60 at the desired position.

Figure 7:
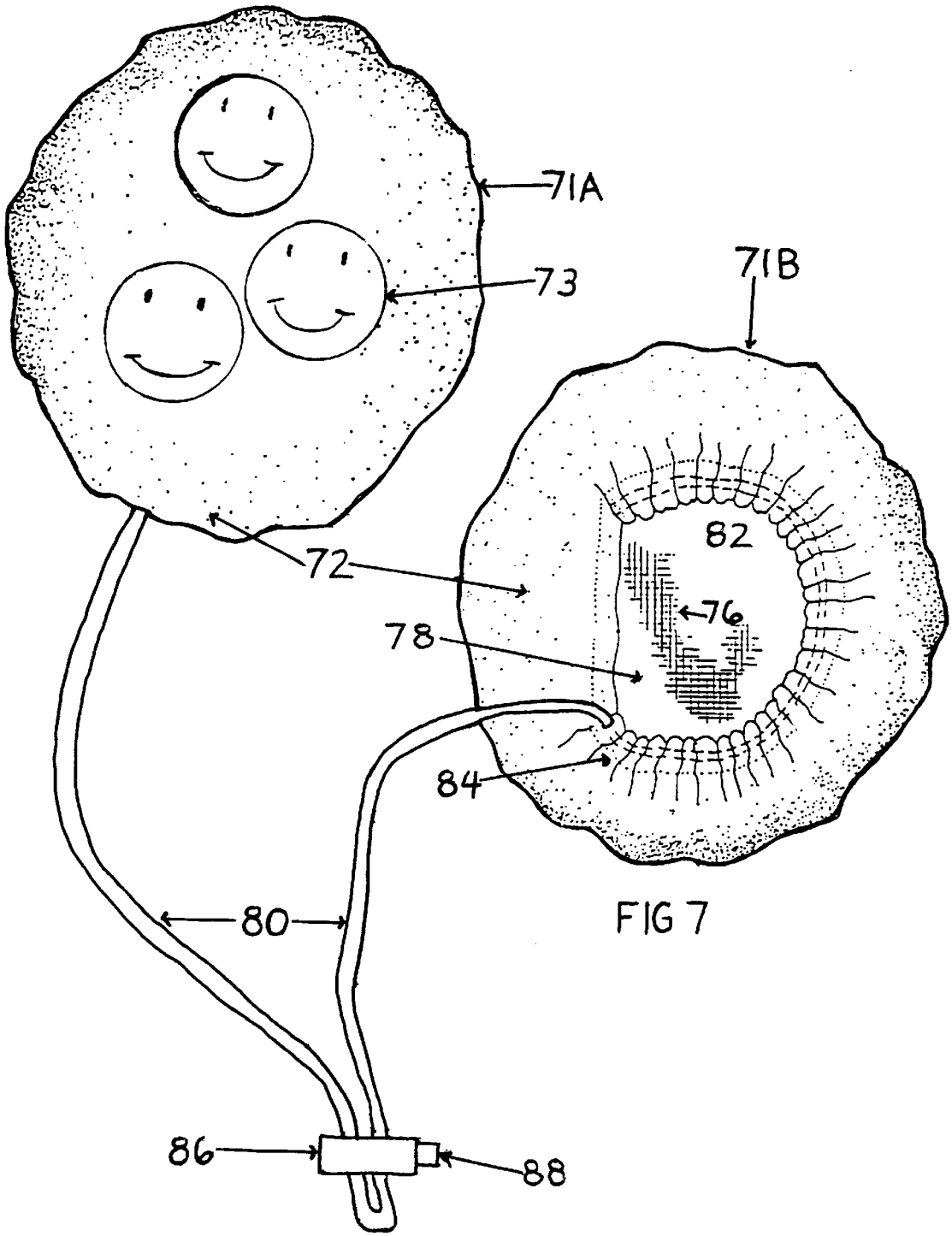
FIG. 7 is a front elevational view of a forth embodiment employing a draw string.

A forth embodiment is illustrated in FIG. 7 of the drawings. The ear protector 70 is substantially the same as the ear protector disclosed in FIG. 6 except a draw string 80 attaches to a first ear protector 71A and a second ear protector 71B. Ear protector 71A is shown "face up" whereas ear protector 71B is shown "face down" such that the outer covering 72 is shown. Outer covering 72 has thereupon a plurality of indicia 73 that adds a sense of style to ear protector 70. Focusing now on ear protector 71A, Drawstring 80 is disposed within inner covering 76 whereas inner covering 76 and outer covering 72 are attached together via stitching 84. Drawstring 80 runs from first ear protector 71A, through drawstring adjuster 86 or drawbead, and to ear protector 71B. Button 88 is located on the end of drawstring adjuster 86 and secures drawstring 80 in a desired position. To adjust the tightness of the drawstring 80 around the user's ear, opening 82 is placed over the user's ear such that the user's ear is placed within chamber 78. By depressing button 88, the drawstring adjuster 86 is slid upwards and towards inner covering 76 until the drawstring 80 is tight around the user's ear. At this point button 88 is then released to secure the drawstring 80 at the desired position. When drawstring 80 is tightened, drawstring 80 fits securely under the wearer's chin area. To secure first and second ear protectors 71A, 71B around the wearer's ears, ear protectors 71A and 71B are first placed around the ear lobes, drawstring 80 is then pulled tight such that the ear protectors 71A, 71B are fitted snugly around the wearer's ears and then button 88 is released to secure drawstring 88 at the desired position.

Figure 8:
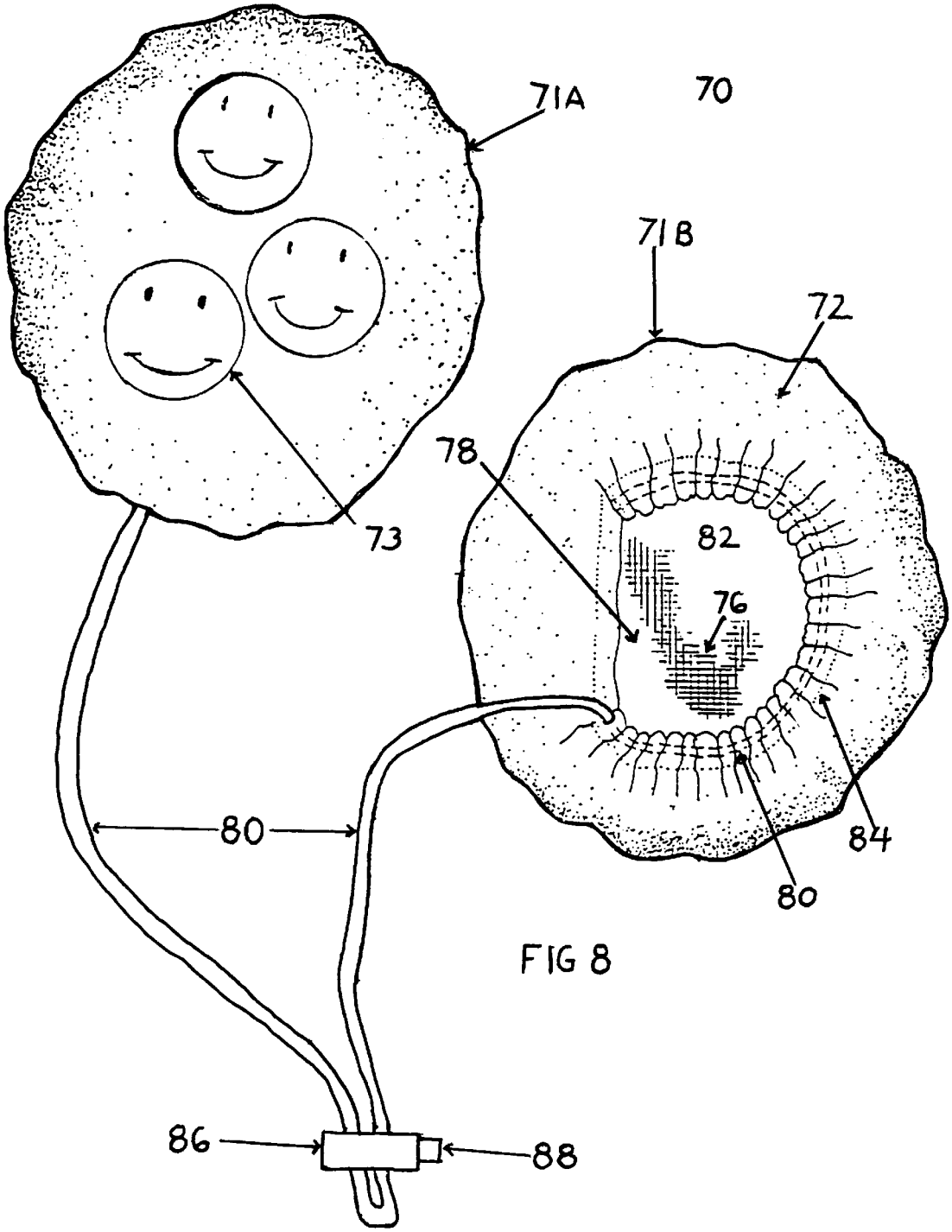
FIG. 8 is a front elevational view of the forth embodiment wherein the ear protectors have a substantially circular shape.
Figure 9:
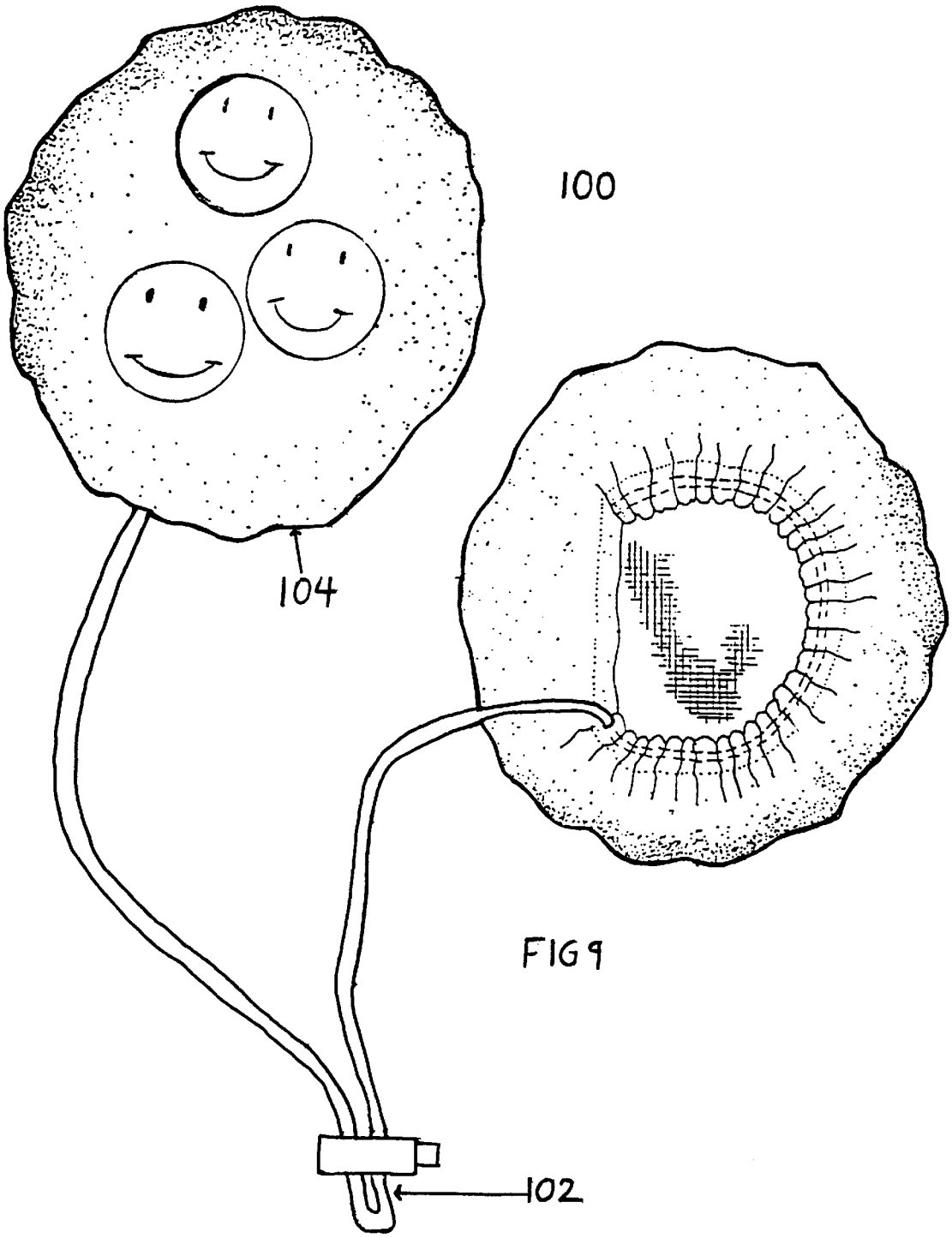
FIG. 9 is a front elevational view of the forth embodiment wherein the ear protectors have a straight edge on one side and a continuous drawstring attached to both ear protectors.

In FIG. 8 of the drawings, ear protectors 90 are shown wherein the ear protectors have a generally circular shape as seen at 94 and have a continuous drawstring 92 which attaches to the two ear protectors. Likewise, FIG. 9 of the drawings shows an ear protector 100 wherein the ear protectors have a straight edge on one side as seen at 104 and a continuous loop drawstring 102 which attaches the two ear protectors 100.

Figure 10:
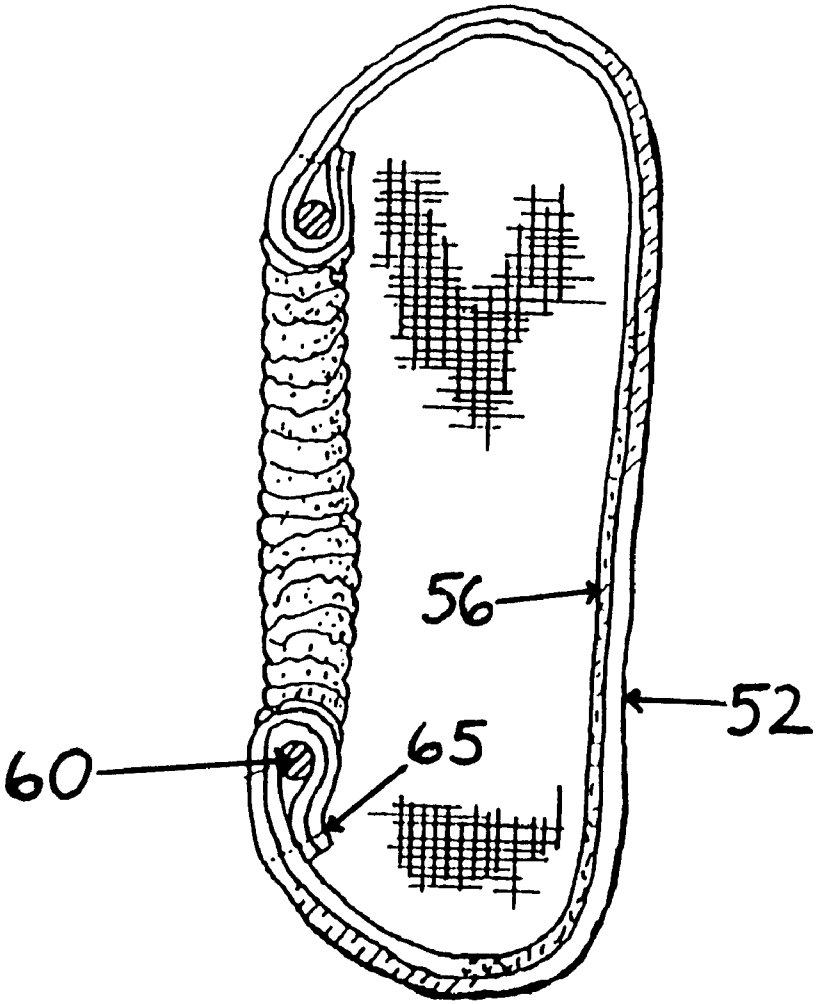
FIG. 10 is a cross-sectional view of FIG. 6.

FIG. 10 of the drawings shows a cross-sectional view of FIG. 6 wherein inner covering 56 is shown to fold over onto itself (seen generally at 65) to form a loop 67 through which drawstring 60 is disposed.

It is to be understood that the present invention is not limited to the sole embodiment described above, but encompasses any and all embodiments within the scope of the following claims.

I claim:

1. An ear protector comprising:

a flexible pocket for closely receiving and completely covering the ear lobe of a user, such that the ear protector is secured to the base of the user's ear, said pocket comprising an outer covering made of a flexible, heat-resistant, non-combustible material and an inner lining comprising a material soft to the touch; said pocket defining a chamber and an opening for passing the ear lobe into said pocket;

said opening having a minimum diameter and a maximum diameter;

a heat shield made of a heat-resistant material, disposed between said outer covering and said inner covering;

closure means for closing said opening around the base of the user's ear; and, a loop wherein said loop is formed when said inner lining is folded over onto itself.

2. The ear protector according to claim 1, wherein said closure means for closing said opening are disposed within said loop.

3. The ear protector according to claim 2, wherein said closure means is a drawstring wherein said drawstring includes a drawbead.

4. The ear protector according to claim 2, wherein said closure means is an elastic member affixed completely within said loop to allow said opening to have its minimum diameter at rest or un-stretched and its maximum diameter when the elastic member is fully stretched.

5. The ear protector according to claim 2, wherein said closure means is an elastic member affixed intermittently to said pocket about an arc of said opening to allow said opening to have its minimum diameter at rest or un-stretched and its maximum diameter when the elastic member is fully stretched.

6. An ear protector comprising:

a first and second ear protector;

each of said first and second ear protectors comprising a flexible pocket for closely receiving and completely covering the ear lobe of a user, said pocket comprising an outer covering made of a flexible, heat-resistant, non-combustible material and an inner lining comprising a material soft to the touch; a heat shield made of a heat-resistant material disposed between said outer covering and said inner covering, said pocket defining a chamber and an opening for passing the ear lobe into said pocket;

said opening having a diameter;

closure means for constricting said diameter of said opening, and;

a loop defined by said inner lining being folded over onto itself wherein said closure means for constricting said diameter are disposed within said loop.

7. The ear protector according to claim 6, wherein said closure means for constricting said diameter is a drawstring passing through said loop wherein said drawstring includes a drawbead.

8. The ear protector according to claim 7, wherein said drawstring is continuous and is attached to said first ear protector and said second ear protector.

9. The ear protector according to claim 6, wherein said outer covering contains indicia thereupon.

* * * * *